US009201402B2

(12) United States Patent
Greubel et al.

(10) Patent No.: US 9,201,402 B2
(45) Date of Patent: Dec. 1, 2015

(54) DEVICE FOR DISPLAYING MULTIPLE TIMES

(75) Inventors: Robert Greubel, Champfahy (CH); Nathalie Lebet, Le Reymond (CH); Dylan Roth, Route des Gouttes-d'Or (CH)

(73) Assignee: GFPI S.A., La Chaux-de-Fonds (CH)

( * ) Notice: Subject to any disclaimer, the term of this patent is extended or adjusted under 35 U.S.C. 154(b) by 14 days.

(21) Appl. No.: 13/996,065

(22) PCT Filed: Oct. 28, 2011

(86) PCT No.: PCT/EP2011/069053

§ 371 (c)(1),
(2), (4) Date: Aug. 29, 2013

(87) PCT Pub. No.: WO2012/084314

PCT Pub. Date: Jun. 28, 2012

(65) Prior Publication Data

US 2013/0329529 A1 Dec. 12, 2013

(30) Foreign Application Priority Data

Dec. 20, 2010 (CH) ..... 2124/10

(51) Int. Cl.
*G04B 19/22* (2006.01)
*G04B 19/23* (2006.01)
*G04B 19/08* (2006.01)

(52) U.S. Cl.
CPC ..... *G04B 19/23* (2013.01); *G04B 19/087* (2013.01)

(58) Field of Classification Search
CPC .... G04B 19/22; G04B 19/025; G04B 19/048; G04B 19/20; G04B 19/202; G04B 19/223
USPC ..... 368/21–27
See application file for complete search history.

(56) References Cited

U.S. PATENT DOCUMENTS

| | | | | |
|---|---|---|---|---|
| 2,251,021 | A * | 7/1941 | Nebergall | 368/21 |
| D190,291 | S * | 5/1961 | Sittser | D10/10 |
| 4,464,058 | A * | 8/1984 | Weller | 368/21 |

(Continued)

FOREIGN PATENT DOCUMENTS

| | | |
|---|---|---|
| CH | 17 190 | 5/1899 |
| DE | 20 2008 010556 | 11/2008 |

(Continued)

OTHER PUBLICATIONS

International Search Report dated Feb. 28, 2012 in corresponding PCT application.

*Primary Examiner* — Amy Cohen Johnson
*Assistant Examiner* — Jason Collins
(74) *Attorney, Agent, or Firm* — Young & Thompson

(57) ABSTRACT

A device for displaying multiple times, includes a first time-displaying member (1) and a second time-displaying member (2) constituting first elements, and a first indicator for indicating at least one time on the first time-displaying member (1) and a second indicator for indicating at least one time on the second time-displaying member constituting second elements, wherein the first (1) and second (2) time-displaying members have a common axis. The first and/or second indicator for indicating at least one time is arranged between the first time-displaying member (1) and the second time-displaying member (2), and the first and/or second indicators are mounted so as to be rotatable about the axis relative to each other at the same rotational speed, wherein the time that can be displayed on the first time-displaying member (1) is different from the time that can be displayed on the second time-displaying member (2).

10 Claims, 15 Drawing Sheets

(56) References Cited

U.S. PATENT DOCUMENTS

| | | | | |
|---|---|---|---|---|
| 4,945,521 | A | 7/1990 | Klaus | |
| 5,708,628 | A * | 1/1998 | Chen | 368/21 |
| 6,243,324 | B1 * | 6/2001 | Teng | 368/21 |
| 7,175,340 | B1 * | 2/2007 | Kinney | 368/282 |
| 7,433,270 | B2 * | 10/2008 | Chen | 368/21 |
| 2005/0105397 | A1 | 5/2005 | Tuason | |
| 2009/0207699 | A1 * | 8/2009 | Buttet et al. | 368/21 |

FOREIGN PATENT DOCUMENTS

| | | |
|---|---|---|
| EP | 1 031 895 | 8/2000 |
| EP | 1 058 166 | 12/2000 |

* cited by examiner

DEVICE FOR DISPLAYING MULTIPLE TIMES

TECHNICAL FIELD

The present invention relates to mechanical timepieces. It more particularly relates to a device for displaying multiple hours.

BACKGROUND OF THE INVENTION

Display devices are known making it possible to display a same hour in two different places. More particularly, document EP 1,031,895 describes a table clock comprising a cylinder on which a strip is arranged having, on its opposite rims, two displays of the same hour, on either side of a city display. This dual display makes it possible to virtually reproduce a single time zone above the world map positioned at the center of the strip.

Display devices making it possible to display at least two different hours are most generally used to display the hours corresponding to at least two different time zones. Such a display of hours may be done in different ways. It is first possible to provide, on the same main dial, two stationary dials each comprising an hour hand respectively displaying a given hour according to a time zone. This display device has the drawback of taking up significant space on the main dial. Two hour hands may also be provided at the center of a same dial displaying a first hour with a first hand, a rotating bezel being used to choose a time zone then display the second corresponding hour using the second hand on the bezel that is then stationary. However, the two hands at the center may make it more difficult to read the hour.

Another possibility is to use a rotating hand associated with the dial and a stationary index on the dial associated with a crown mounted rotating around the dial. The names of cities may be inscribed on the crown, making it possible to choose time zones. To take the summer time and winter time into account, in addition to time zones, it is possible to add, on the left of the name of the concerned city, a piece of information, such as an S for "summer" making it possible to read the summer time if applicable. However, the display device obtained may lack clarity, the hour not being clearly displayed using an index associated with a figure.

One aim of the present invention is therefore to offset these drawbacks, by proposing a display device enabling easy reading of the hours on two display organs for distinct hours.

Another aim of the present invention is to propose a display device allowing easy reading of the winter time and summer time.

BRIEF DESCRIPTION OF THE INVENTION

To that end, and according to the present invention, proposed is a device for displaying multiple hours comprising a first hour display organ, a second hour display organ, forming first elements, first means indicating at least one hour on the first hour display organ and second means indicating at least one hour on the second hour display organ, forming second elements, the first and second hour display organs having a shared axis.

According to the invention, at least one of the first and second means for indicating at least one hour is positioned between the first hour display organ and the second hour display organ, and one group from among the first and second elements are mounted rotating around said axis with respect to the other of said first and second elements, with a same speed of rotation, the hour that may be displayed on the first hour display organ being different from the hour that may be displayed on the second hour display organ.

Preferably, the first and second means for indicating at least one hour can be positioned between the first hour display organ and the second hour display organ. Advantageously, said first and second indicator means may be united on the same parts.

According to alternative embodiments, the first and second means for indicating at least one hour may respectively comprise at least one index with which a piece of information related to a location is associated.

According to preferred alternative embodiments, the first and second means for indicating at least one hour may respectively comprise at least one index with which the same information related to a location is associated.

According to one preferred alternative embodiment, the first and second hour display organs and the first and second means indicating at least one hour may also be arranged so as to be able to be positioned relative to one another such that the deviation between the hours displayed on the hour display organs by the indexes of the first and second indicator means for indicating at least one hour, with which the same information related to location is associated, is an hour so as to have a summer time/winter time display.

In other alternative embodiments, the first and second hour display organs and the first and second means indicating at least one hour may also be arranged to be able to be positioned relative to one another such that the deviation between the hours displayed on the hour display organs by the indexes of the first and second means for indicating at least one hour, with which a piece of information related to a different location is respectively associated, is at least one hour so as to have a display of the hours according to two different time zones.

According to alternative embodiments, the first and second hour display organs may respectively have a circular shape and the first and second means indicating at least one hour respectively have a circular shape concentric to the first and second display organs and bearing at least one index to indicate the hour on the associated display organ.

According to other alternative embodiments, the first and second hour display organs may respectively assume the form of a cylinder and the first and second means for indicating at least one hour respectively assume the form of a cylinder concentric to the first and second display organs and bearing at least one index to indicate the hour on the associated display organ. The base of the cylinder may be circular or ellipsoid.

According to alternative embodiments, the first and second means for indicating at least one hour can be arranged such that their respective indexes, with which a piece of information related to a location is associated, are aligned.

According to other alternative embodiments, the first and second means for indicating at least one hour can be arranged such that their respective indexes, with which a piece of information related to a location is associated, have a curved shape in the extension of each other.

According to alternative embodiments, each of the first and second display organs may have one color to display the hours corresponding to the daytime and another color to display the hours corresponding to the nighttime.

According to alternative embodiments, the display device may comprise a retractable flap arranged to cover one of the hour display organs.

The present invention also relates to a timepiece comprising a display device as defined above and rotational driving means designed to rotate one group from among the first and second movable elements at the same speed of rotation.

BRIEF DESCRIPTION OF THE DRAWINGS

The invention will be better understood upon reading the following description, provided as an example and done in reference to the drawings, in which.

DETAILED DESCRIPTION OF THE INVENTION

One particular embodiment of the invention, making it possible to display winter times and summer times, will be described in reference to the figures.

Figure 1:
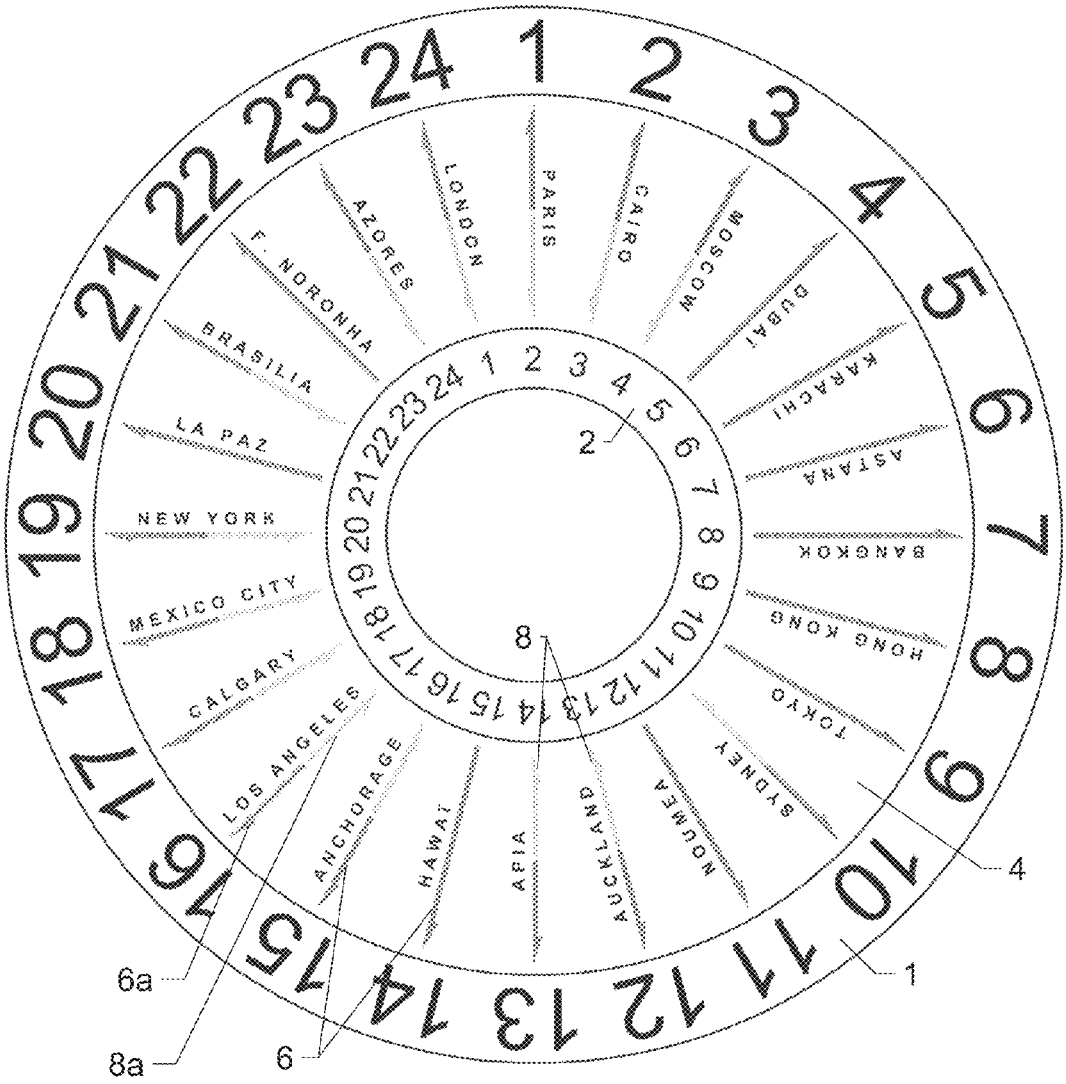
FIG. 1 shows a top view of a first alternative of a display device according to the invention, comprising display organs and circular hour-indicating means.

FIG. 1 shows a first alternative of an hour display device according to the present invention, comprising a first hour display organ 1 and a second hour display organ 2, each having a circular shape and a same axis, and on each of which 24 graduations are regularly distributed, corresponding to 24 hours. The first display organ 1 displays the winter times, while the second display organ 2 displays the summer times.

The hour display device also comprises first means indicating at least one hour arranged to indicate the hour of the first hour display organ 1 and second means indicating at least one hour arranged to indicate the hour on the second hour display organ 2.

According to the invention, and in the alternative shown in FIG. 1, the first and second means for indicating at least one hour are positioned between the first and second hour display organs 1 and 2, such that said first and second means indicating at least one hour form a single piece and correspond to reference 4. In the illustrated alternative, the first and second means indicating at least one hour 4 form a single circular piece, concentric to the first and second hour display organs 1 and 2. On this piece 4, 24 first indexes 6 are regularly distributed that are associated with the names of cities distributed among the 24 time zones. The index 6 here assumes the form of a straight line ending, at the end thereof on the side of the first display organ 1, with an arrow so as to clearly indicate the hour to be displayed on said first display organ 1. Also distributed on the piece 4 are second indexes 8 also assuming the form of a straight line ending, at its end on the side of the second display organ 2, with an arrow so as to clearly indicate the hour to be displayed on said second display organ 2. The indexes can of course assume any other form adapted to the present invention. In particular, the indexes can assume the form of straight angular sectors, in each of which the name of a city is inscribed.

In the illustrated alternative, the first and second hour display organs 1 and 2 are positioned such that the graduation corresponding to the hour H provided on the first display organ 1 is aligned with the axis of said display organs 1 and 2 and with the graduation corresponding to the hour H+1 provided on the second display organ 2, so as to be able to display the winter time and the summer time. Furthermore, the indexes 6 and 8 of the first and second hour-indicating means are positioned such that the indexes 6 and 8 with which the same city name is associated are aligned. Thus, the index 6*a* and the index 8*a* associated with the city of Los Angeles are aligned to clearly indicate that the summer time may apply to Los Angeles, and in particular that when it is 4:00 p.m. in Los Angeles in the winter, it is 5:00 p.m. in Los Angeles in the summer.

No second index 8 is provided for cities where the summer time is not applicable. A blank or other pattern may be provided corresponding to the associated index 6. It is also possible to extend the line of the associated index 6. For example, in reference to FIG. 1, the line for the index 6 associated with Hawaii extends toward the second hour display organ 2 but does not end with an arrow so as to indicate that summer time is not applicable to Hawaii.

According to a first alternative of the invention, the first and second display organs 1 and 2 are stationary, and the first and second hour indicators, united in one piece 4, are rotatably mounted around the axis of the display organs, to perform one revolution in 24 hours.

The user can rotate the piece 4 so as for example to adjust the winter time to be displayed in the selected time zone. Then, the piece 4 rotates clockwise while displaying the winter time for each of the cities associated with the index 6 and the summer time for each of the cities associated with the index 8 when the summer time is applicable. Thus, when it is for example 1:00 a.m. in Paris in the winter, the user easily knows, upon reading the first indexes 6, that it is 3:00 a.m. in Moscow and 4:00 a.m. in Dubai. When it is 1:00 a.m. in Paris in the summer, the user easily knows, upon reading the first indexes 6 and second indexes 8 that are present, that it is 3:00 a.m. in Moscow, but also 3:00 a.m. in Dubai.

Figure 2:
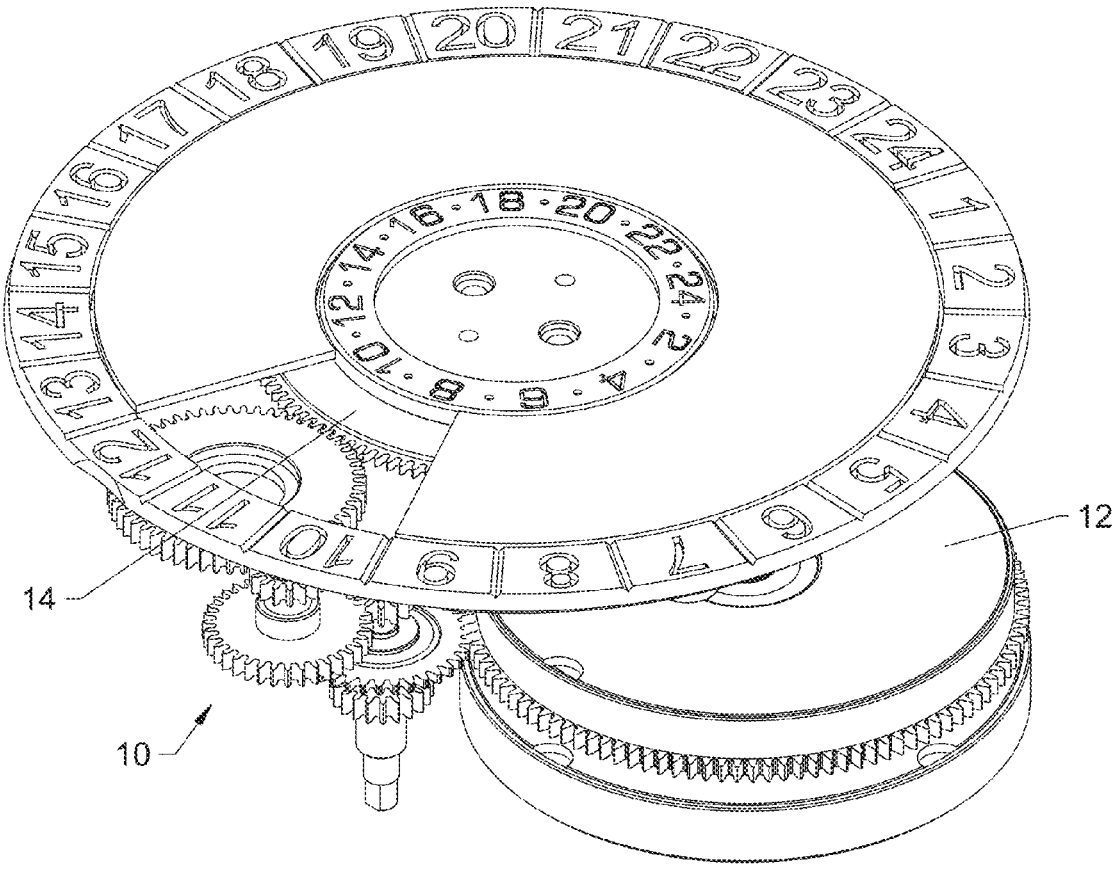
FIG. 2 diagrammatically shows the rotational driving means of one alternative of a timepiece comprising a display device according to the invention.

FIG. 2 diagrammatically shows driving means of the piece 4. In the illustrated alternative, the first hour display organ 1 has an annular shape, the second hour display organ 2 is in the form of a disc, and the hour-indicating means assume the form of an annular piece 4. The driving means of the piece 4 comprise a gear train 10 cooperating on the one hand with the barrel 12 and on the other hand with a wheel 14 secured to the piece 4.

According to another alternative not shown, the direction of the graduations on the display organs, and the order of the cities, can be reversed, in this case making the direction of rotation of the piece 4 counterclockwise. Likewise, it is possible to reverse the indexes 6 and 8 such that the summer time can be read on the first hour display organ 1 when it is applicable and the winter time is read on the second hour display organ 2.

According to a second alternative of the invention, the first and second hour-indicating means, i.e., the piece 4, are stationary, and the first and second display organs 1 and 2 are rotatably mounted around their axis, in the counterclockwise direction, at the same speed of rotation to perform one revolution in 24 hours. The direction of the graduations on the display organs, and the order of the cities, can be reversed, in which case the direction of rotation of the first and second hour display organs 1 and 2 will be clockwise.

Figure 3:
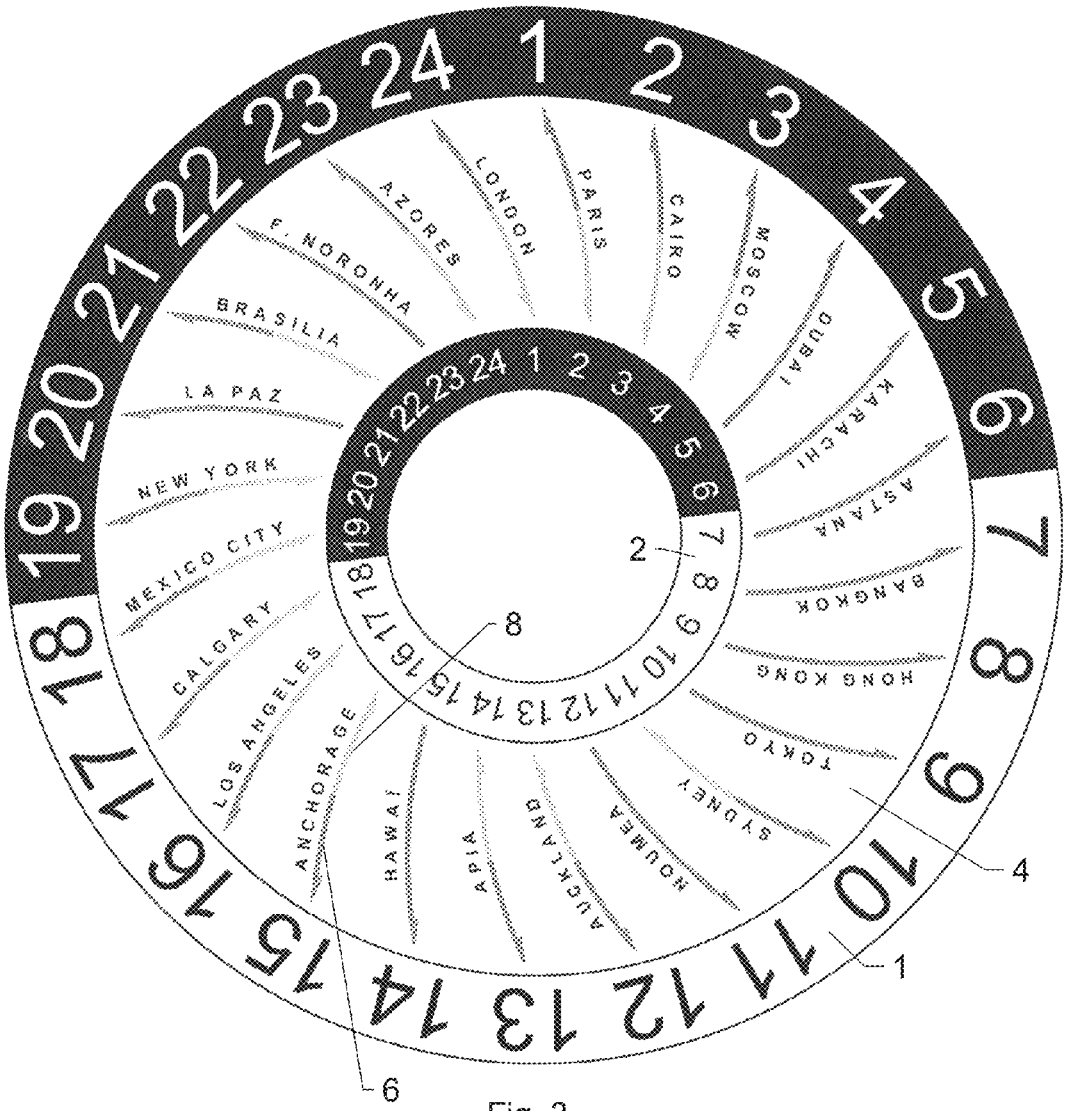
FIG. 3 shows a top view of another alternative of a display device according to the invention, comprising display organs and circular hour-indicating means.

In the alternative shown in FIG. 3, for which the same elements are shown using the same references, the indexes 6 and 8 associated with a same city respectively have a curved shape in the extension of one another. The graduations corresponding to the same hours on the first and second hour display organs 1 and 2 are aligned with respect to their axis, such that the indexes 6 and 8 associated with a same city, being inclined, display, for a same city, the winter time and the summer time when applicable. The curved indexes can be replaced by curved angular sectors, at the middle of each of which the name of a city is inscribed. The curved indexes can also be replaced by straight lines connected by a transverse straight line.

Each of the first and second hour display organs 1 and 2 has a light color for the hours between 7 a.m. and 6 p.m. and a dark color for the hours between 7 p.m. and 6 a.m. for a day/night display. Of course, other time intervals may be chosen.

According to the invention, either the first and second hour display organs 1 and 2 are rotatable, at the same speed to perform one revolution in 24 hours, and the piece 4 is stationary, or the first and second hour display organs 1 and 2 are stationary and the piece 4 is rotatable to perform one revolution in 24 hours.

Figure 4:
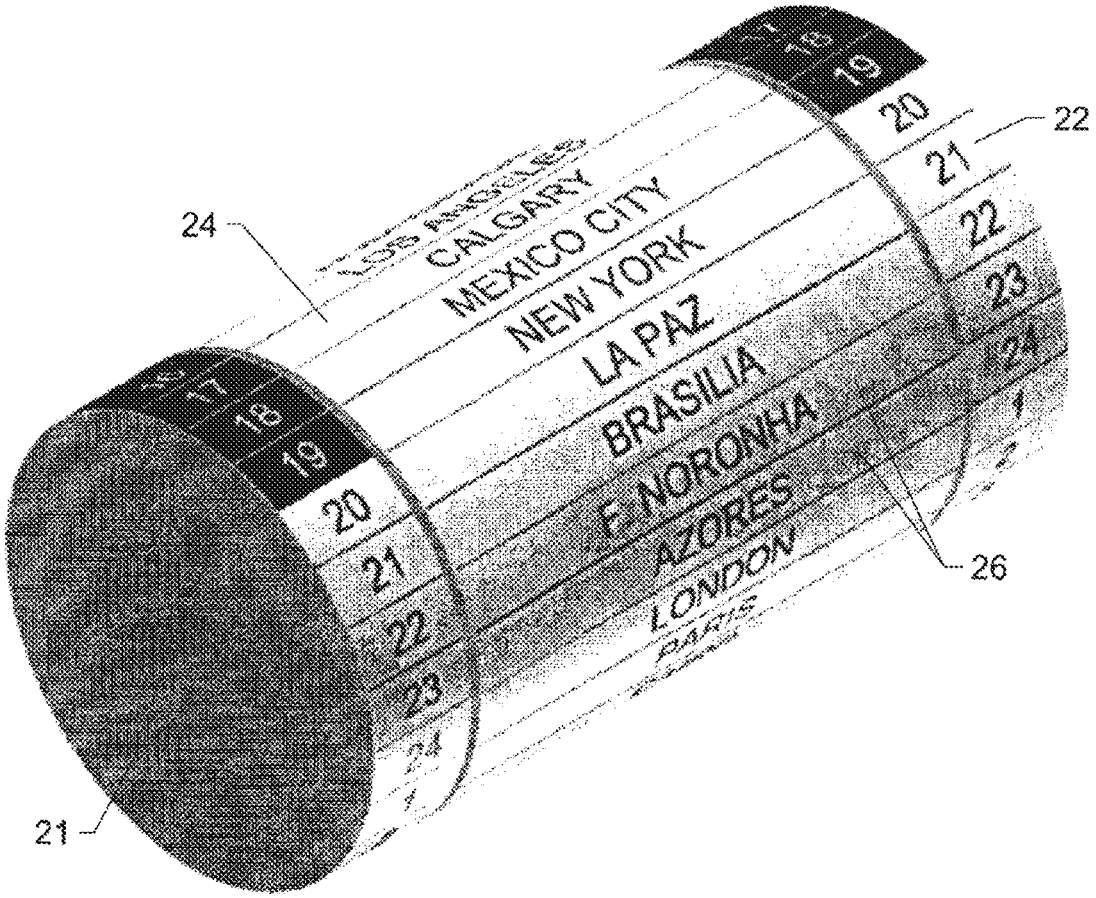
FIGS. 4 and 5 show an isometric view of alternatives of a display device according to the invention, comprising display organs and cylindrical hour-indicating means.
Figure 5:
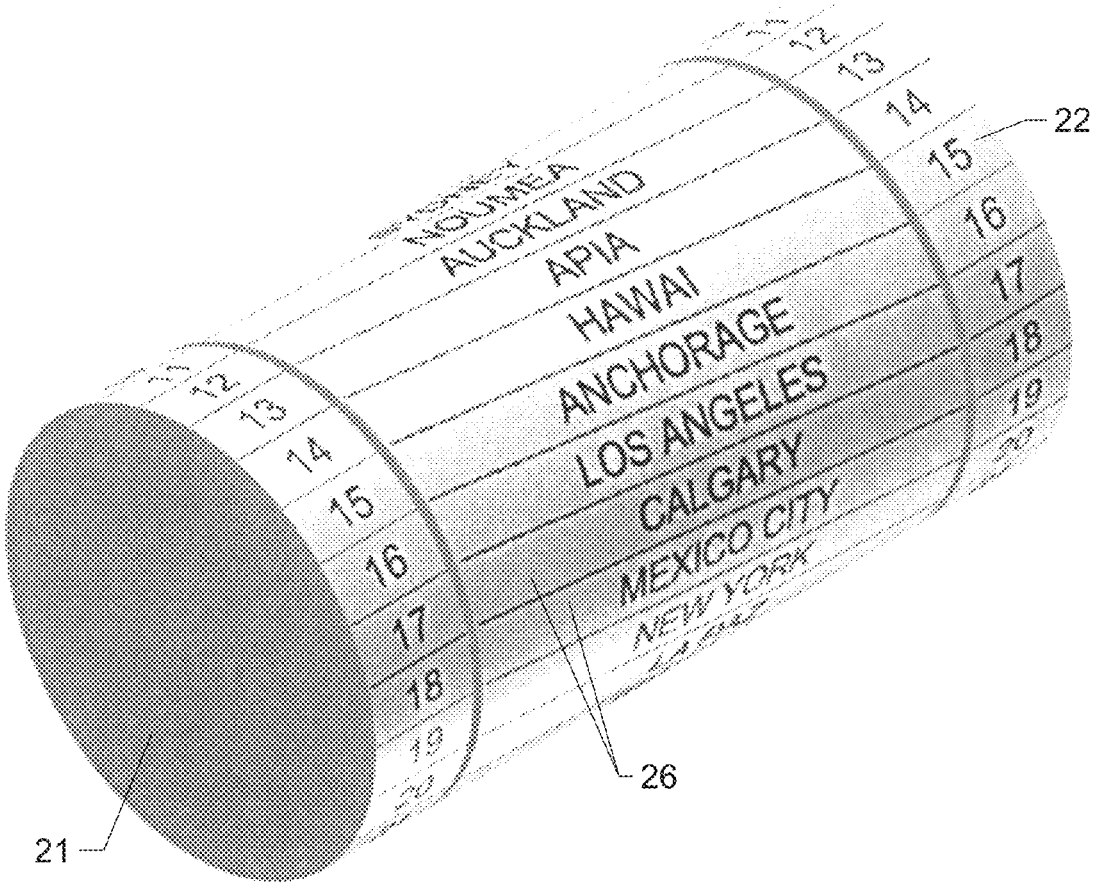

According to the alternatives shown in FIGS. 4 and 5, the first hour display organ 21 and the second hour display organ 22 are respectively cylindrical, with a circular base, and have the same longitudinal axis. Each of these cylinders bears 24 regularly-distributed graduations, corresponding to 24 hours. The first display organ 21 displays the winter times, while the second display organ 22 displays the summer times. The first hour-indicating means and the second hour-indicating means are positioned between the first and second hour display organs 21 and 22, such that said first and second hour-indicating means form a single cylindrical piece 24 with a circular base, having the same longitudinal axis and the same diameter as the cylinders of the display organs 21 and 22. On this piece 24, there are 24 strips 26 that are regularly distributed, inside each of which the name of a city is inscribed corresponding to one of the 24 time zones. The end of each strip 26 across from the first hour display organ 21 serves as a first index to display the winter time on the first hour display organ 21 and the end of each strip 26 across from the second hour display organ 22 serves as a second index to display, on the second hour display organ 22, the summer time corresponding to the same city.

According to the invention, either the first and second hour display organs 21 and 22 are rotatable, at the same speed to perform one revolution in 24 hours, and the piece 24 is stationary, or the first and second hour display organs 21 and 22 are stationary and the piece 24 is rotatable to perform one revolution in 24 hours. The directions of rotation may be clockwise or counterclockwise depending on the arrangement of the graduations and the order of the cities.

In the alternative shown in FIG. 4, the strips 26 are straight, i.e., parallel to the longitudinal axis of the cylinders, and the first and second hour display organs 21 and 22 are positioned such that the graduation corresponding to the hour H provided on the first display organ 21 is aligned, parallel to the longitudinal axis of the cylinders, with the graduation corresponding to the hour H+1 provided on the second display organ 22, for the same city, so as to be able to display the winter time and the summer time for a same city.

Each of the first and second hour display organs 21 and 22 has a light color for the hours between 7 a.m. and 6 p.m. and a dark color for the hours between 7 p.m. and 6 a.m. for a day/night display.

According to the alternative shown in FIG. 5, the strips 26 are inclined with respect to the longitudinal axis of the cylinders, and the first and second hour display organs 21 and 22 are positioned such that the graduation corresponding to the hour H provided on the first display organ 21 is aligned, parallel to the longitudinal axis of the cylinders, with the graduation corresponding to the same hour H provided on the second display organ 22 for the same city, so as to be able to display the winter time and the summer time for a same city using inclined strips 26.

According to an alternative that is not shown, it is possible to provide an aperture allowing a preferred display of a single city and a single hour on each of the hour display organs 21 and 22.

In another alternative that is not shown, a retractable flap may be provided that is arranged to cover one of the hour display organs 21 or 22 so as for example only to display a single hour in the case where the summer time is not applicable.

Depending on the user's desire, the first and second hour display organs 21 and 22 and the piece 24 can be arranged to be able to rotate the piece 24 so as to display a preferred city, and the first and second display organs will rotate so as to display the corresponding hours. The piece 24 then remains immobile and locked on the selected city, the first and second hour display organs 21 and 22 then being rotatable. When the user wishes to choose to display another preferred city, the first and second hour display organs will rotate so as to display the corresponding hours.

In one alternative that is not shown, the base of the cylinders has an ellipsoid shape.

In another alternative that is not shown, only the indexes associated with a same city for which summer time applies are displayed.

One skilled in the art may easily adapt the examples described above to the more general cases of displaying hours corresponding to different time zones. In particular, in reference to FIG. 6, it may be provided that the first and second means indicating at least one hour constitute two different pieces 34, 36, which can be rotated to be positioned relative to one another as a function of the selected time zones. Each of the first and second hour-indicating means includes 24 indexes, respectively referenced 38 and 40, each of which is associated with the name of a city corresponding to one of the 24 time zones. Initially, the piece 34 corresponding to the first hour-indicating means is separated from the piece 36 corresponding to the second hour-indicating means so as to position it to display the hour on the first display organ 31, according to a first time zone chosen using the first indexes 38, and the piece 36 is positioned to display the hour on the second display organ 32, according to a second time zone chosen using the second indexes 40, the first and second indexes 38, 40 being in the extension of one another for simplified reading. When adjusting the time zone, the second display organ 32 is arranged so as to rotate with the piece 36. During operation, the piece 36 is separated from the second display organ 32. The pieces 34 and 36 rotate at the same speed or the first and second hour display organs 31 and 32 rotate at the same speed so as to display the hours according to two time zones, using two indexes 38, 40 in the extension of one another.

Figure 6:
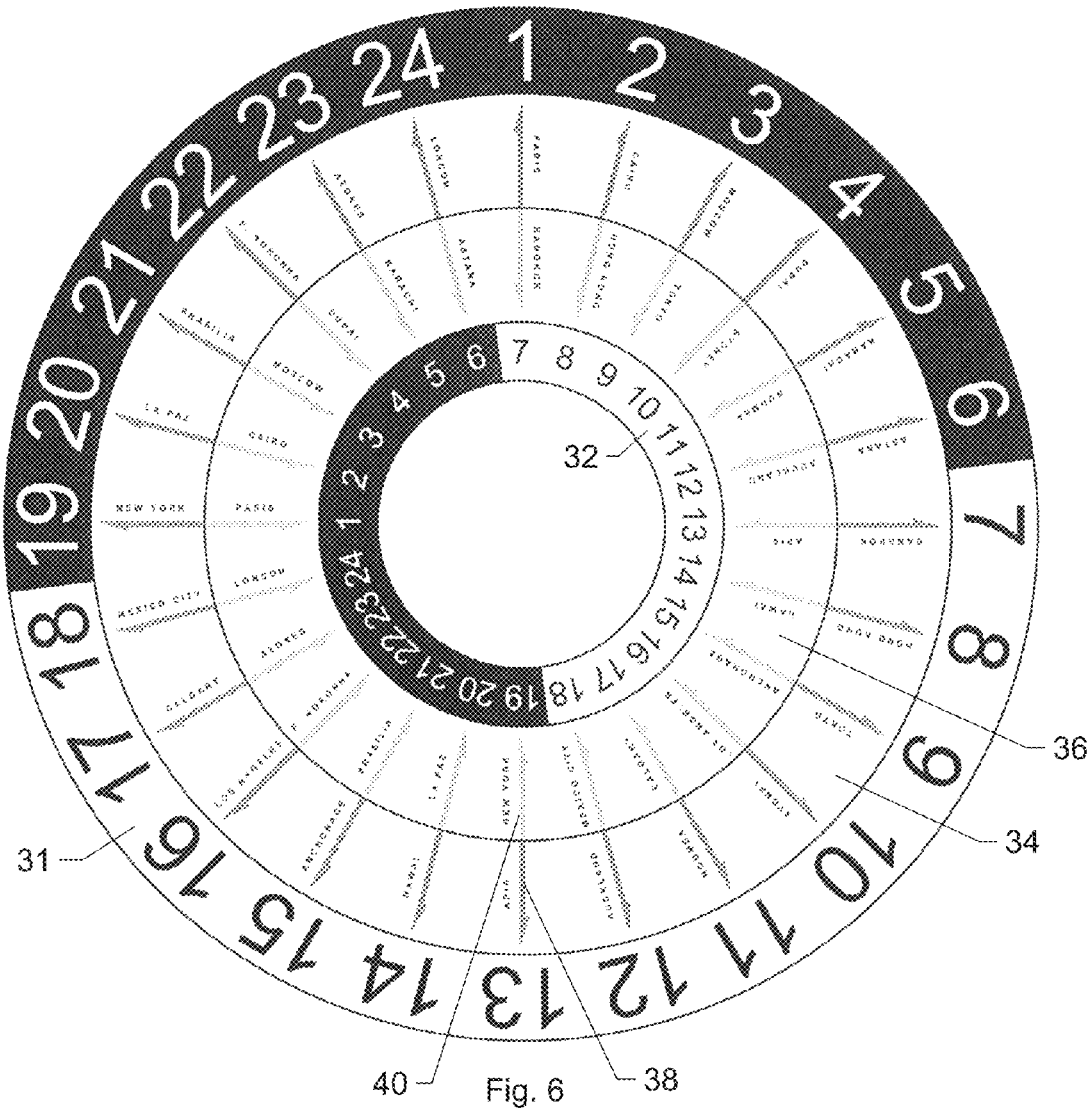
FIGS. 6 and 7 show a top view of two other alternatives of a display device according to the invention, comprising display organs and circular hour-indicating means.
Figure 6A:
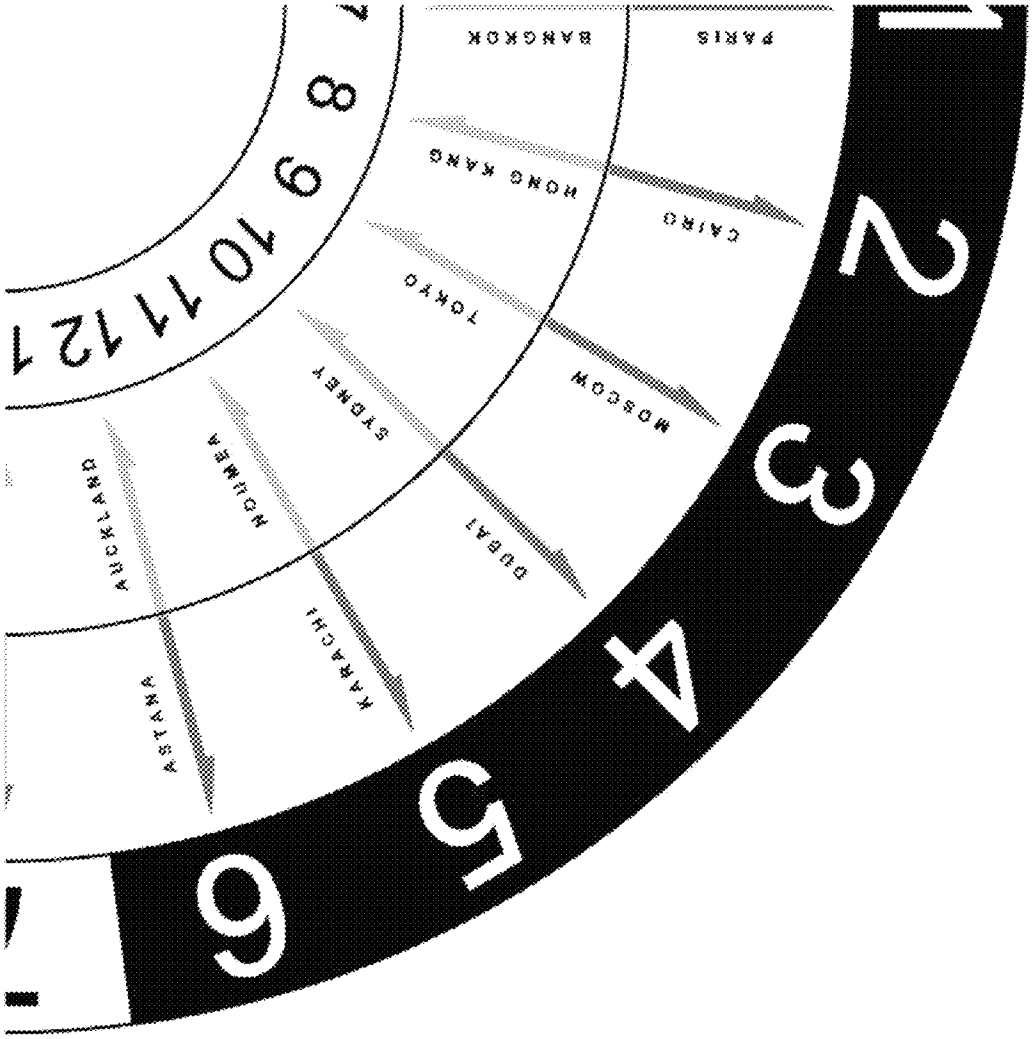
Figure 6B:
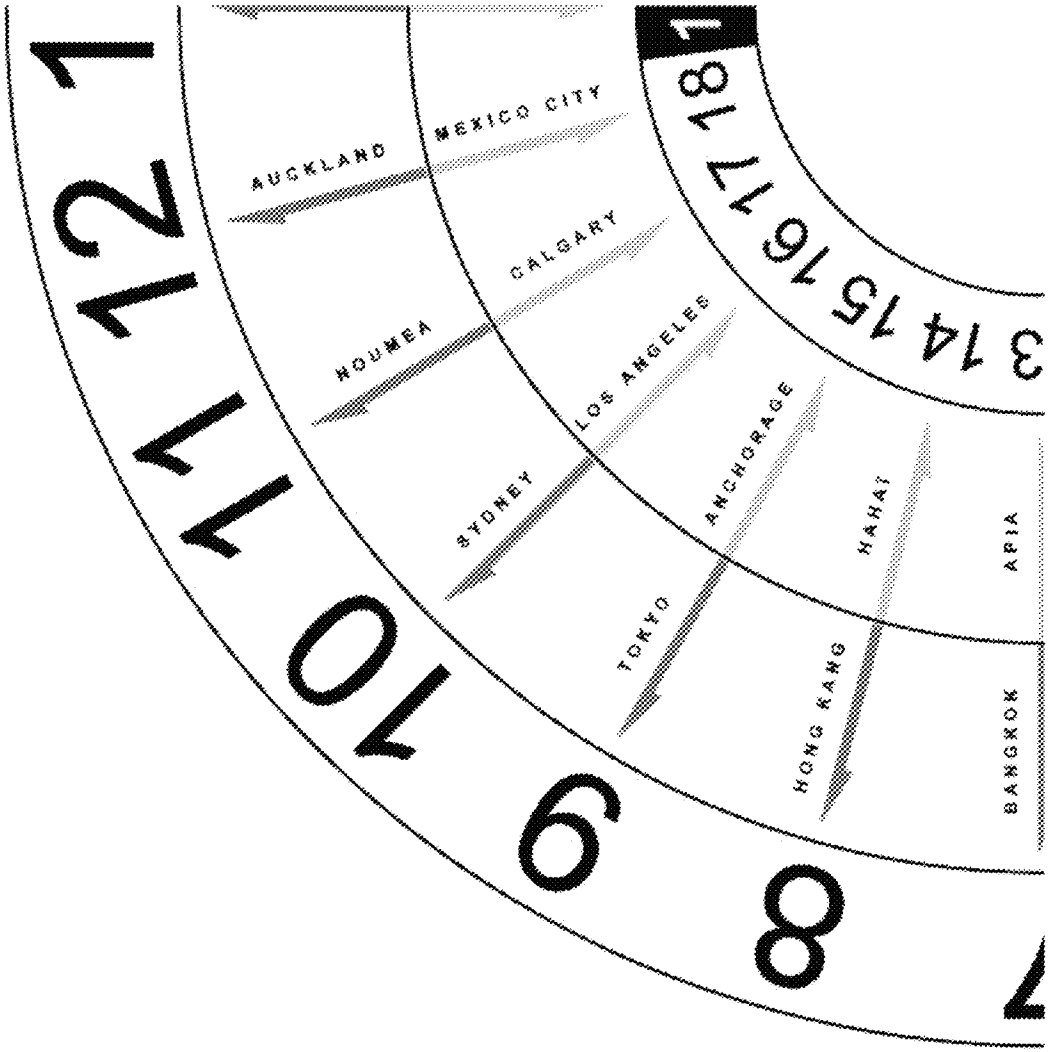
Figure 6C:
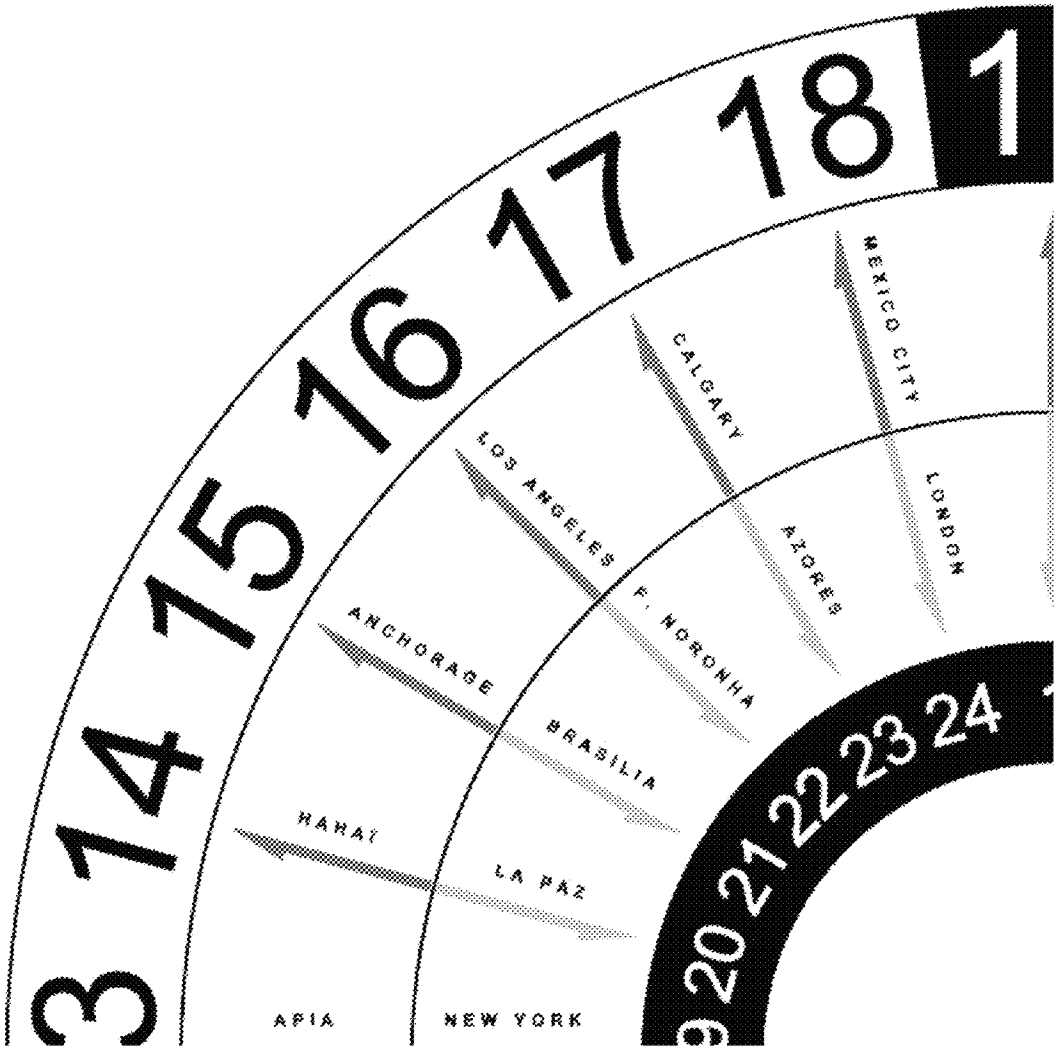
Figure 6D:
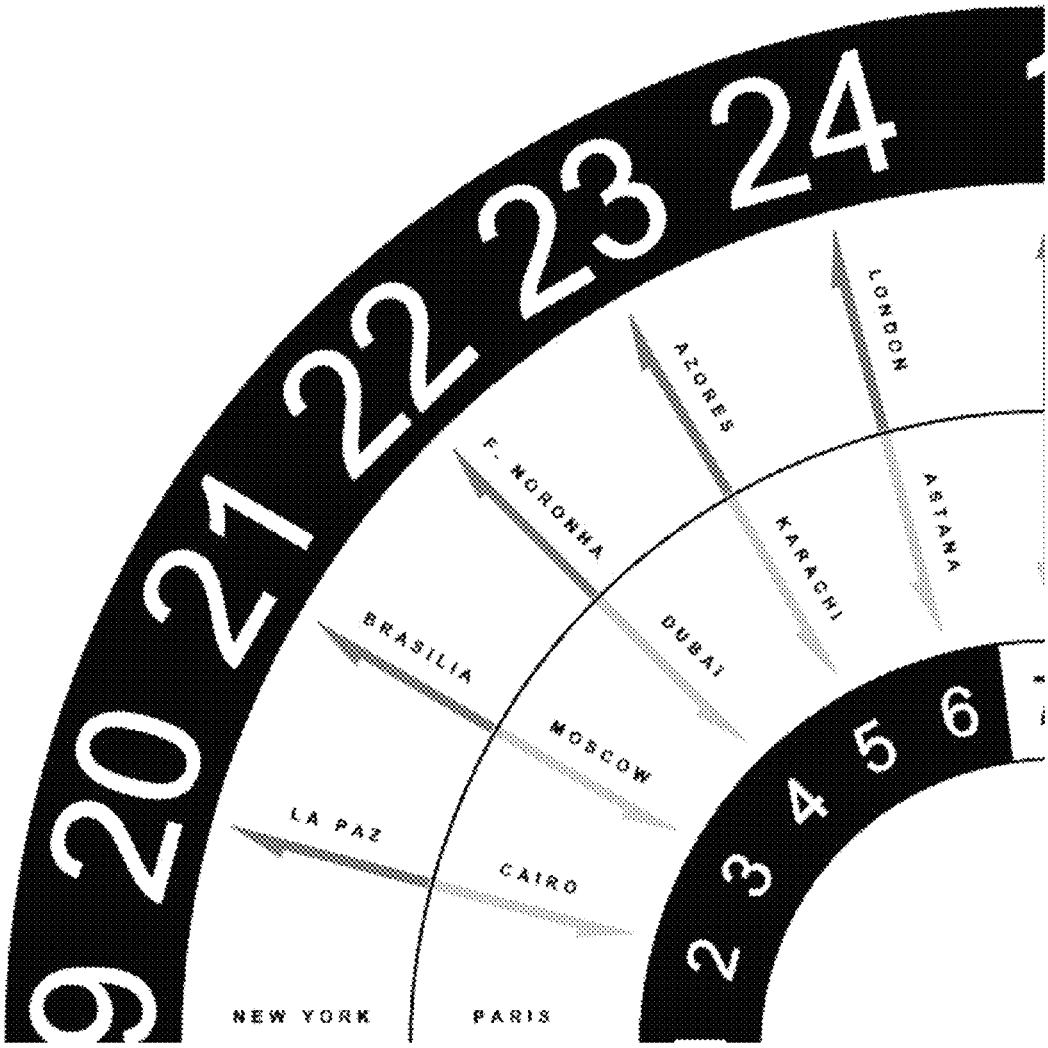

Thus, in the example shown in FIG. 6, a user located in Paris wishes to know the time in Bangkok. The user therefore rotates the piece 36 such that the index 38 associated with the city of Paris is aligned with the index 40 associated with the city of Bangkok. The reading of two time zones is thus simplified.

Figure 7:
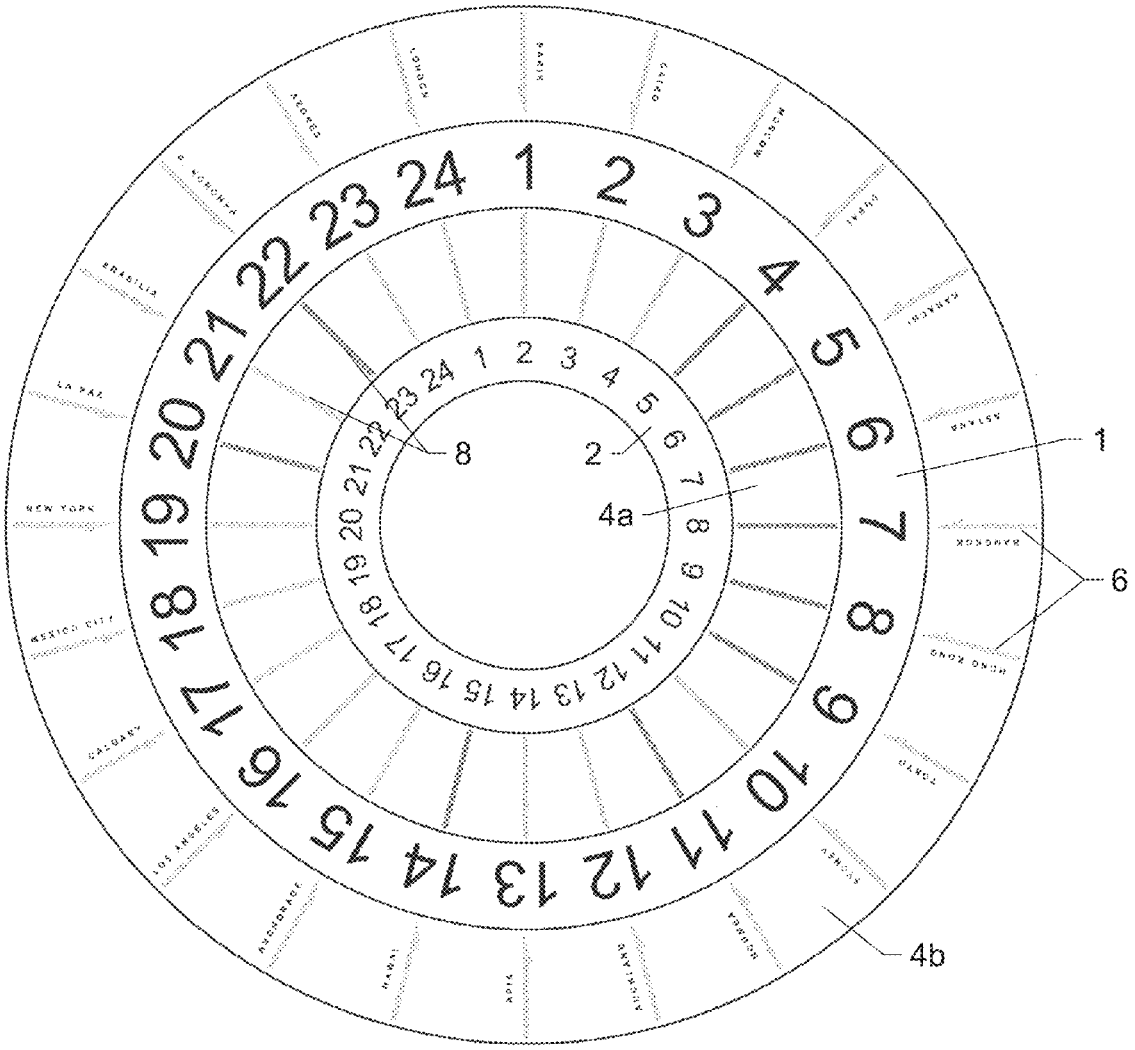
Figure 7A:
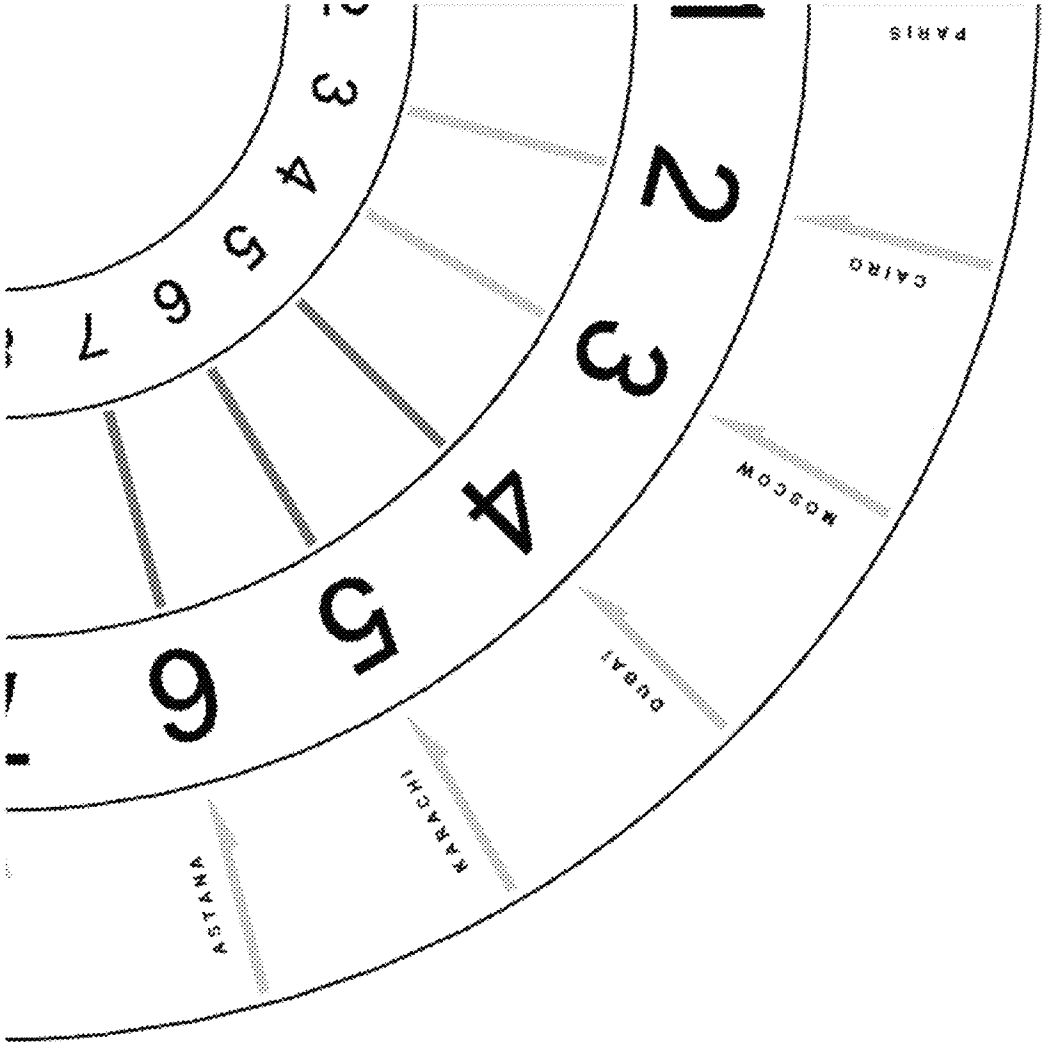
Figure 7B:
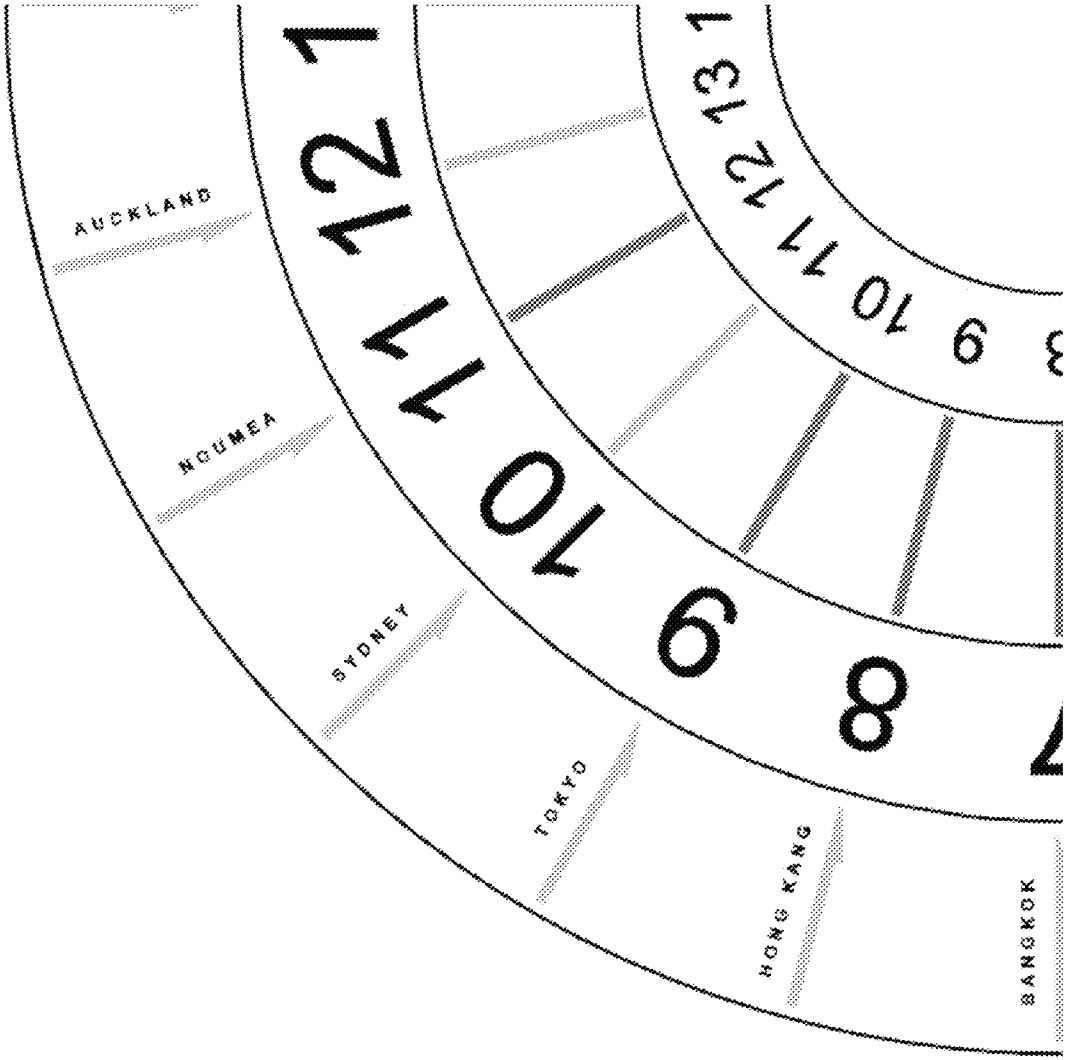
Figure 7C:
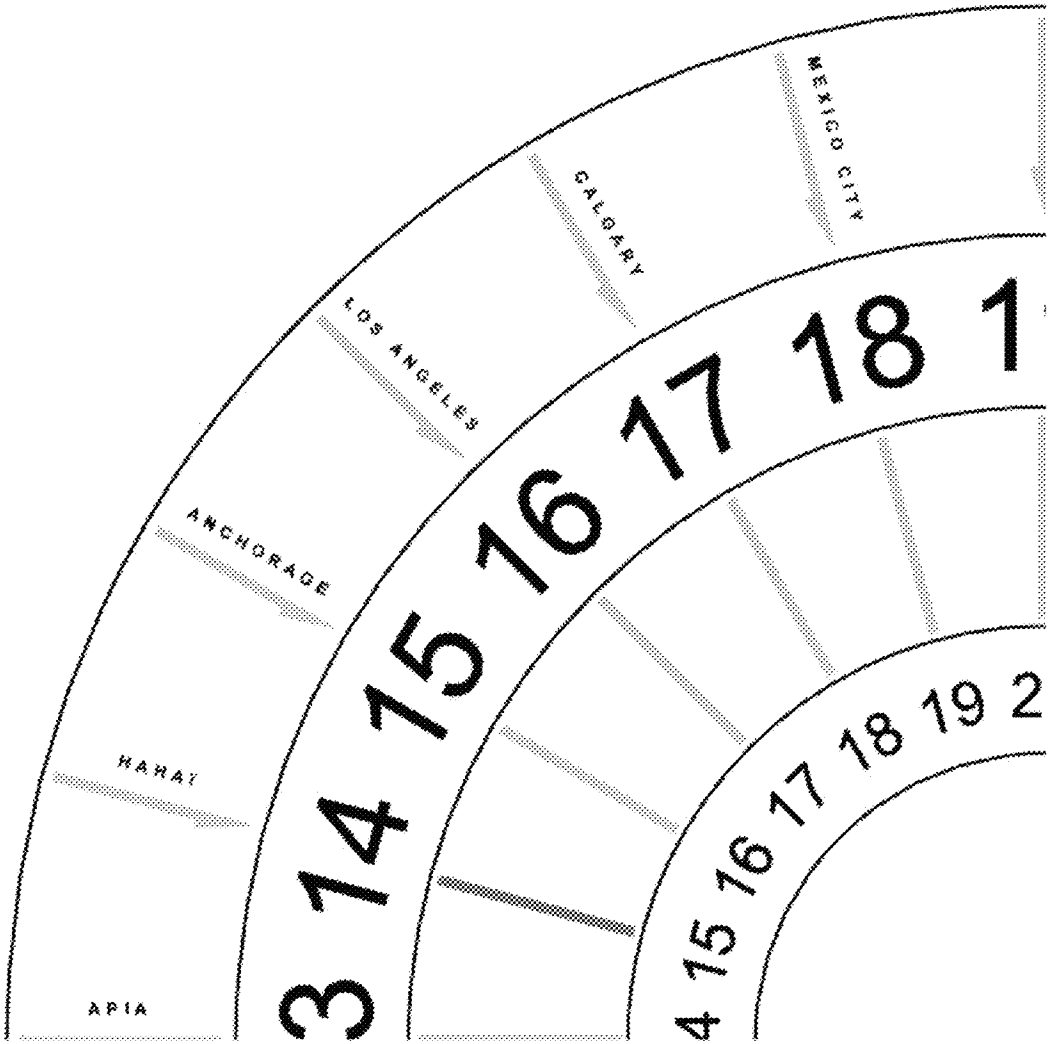
Figure 7D:
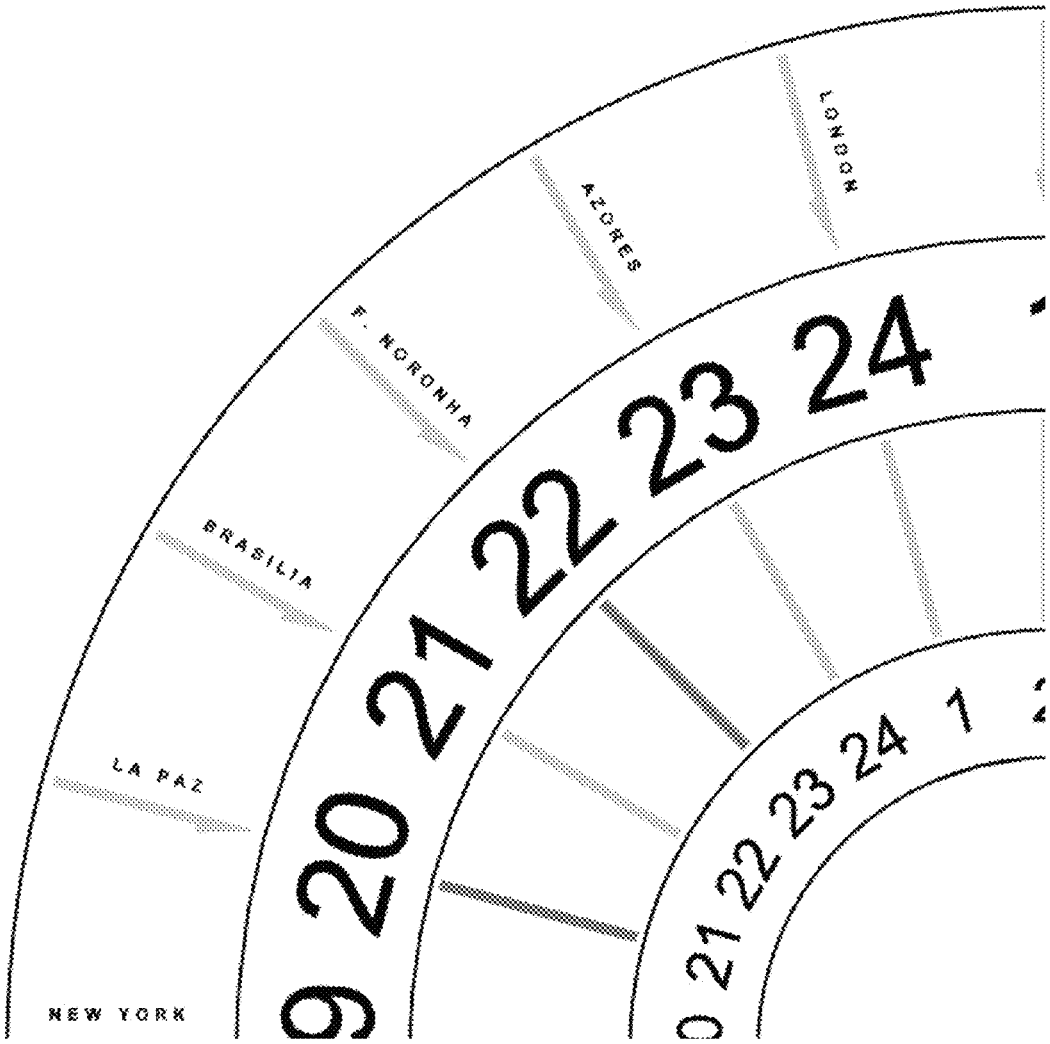

The alternative shown in FIG. 7 substantially corresponds to the alternative shown in FIG. 1, with the exception of the arrangement of the hour-indicating means. The same elements are shown using the same references. In the alternative of FIG. 7, only the second hour-indicating means formed by the piece **4*a* bearing the second indexes 8 are positioned between the first and second hour display organs 1 and 2 to display the summer time on said second hour display organ 2. The first hour-indicating means formed by the piece 4***b* bearing the first indexes 6 are positioned around the first hour display organ 1 to display the winter time on said first hour display organ 1. The name of the cities may appear only on the piece 4*b*, associated with each first index 6. The index 8 provided on the piece 4*a* associated with a city being aligned with the index 6 associated with the same city provided on the piece 4*b*, the reading of the winter time and the summer time when applicable is simplified. The operation of this device is identical to that of the alternative of FIG. 1.

The present invention is of course not limited to the illustrated examples. In particular, the shape of the indexes, the graduations, and the colors of the various elements may vary. Only certain hours may appear on the display organs. The information related to a location may differ from the names of cities. In particular, the names of sporting venues, stores, or any other information involving a time difference may appear.

The invention claimed is:

1. A device for displaying multiple hours comprising:

a first hour display organ and a second hour display organ, said first hour display organ and said second hour display organ together constituting first elements, wherein the first and second hour display organs have a shared axis; and first means indicating at least one hour on the first hour display organ and second means indicating at least one hour on the second hour display organ, said first means and said second means together constituting second elements, wherein at least one of the first and second means for indicating at least one hour is positioned between the first hour display organ and the second hour display organ, wherein all component parts constituting one group from among said first and second elements are mounted rotating around said axis with respect to all component parts constituting the other of said first and second elements, all component parts of said one group rotating with a same speed of rotation of one turn in twenty four hours, the hour that is displayed on the first hour display organ being different from the hour that is displayed on the second hour display organ, wherein the first and second means for indicating at least one hour respectively comprise at least one index with which a piece of information related to a location is associated, and wherein the first and second hour display organs and the first and second means indicating at least one hour are also arranged positionable relative to one another such that a deviation between the hours displayed on the hour display organs by the indexes of the first and second indicator means for indicating are at least one hour.

2. The display device according to claim 1, wherein the first and second means for indicating at least one hour can be positioned between the first hour display organ and the second hour display organ.

3. The display device according to claim 1, wherein the first and second means for indicating at least one hour respectively comprise at least one index with which said piece of information related to a location is associated, such that the deviation between the hours displayed on the hour display organs by the indexes of the first and second indicator means for indicating at least one hour, with which the said piece of information related to location is associated, is an hour so as to have a summer time/winter time display.

4. The display device according to claim 1, wherein the first and second means for indicating at least one hour respectively comprise at least one index with which an information related to a different location is associated such that the deviation between the hours displayed on the hour display organs by the indexes of the first and second means for indicating at least one hour, so as to have a display of the hours according to two different time zones.

5. The display device according to claim 1, wherein the first and second hour display organs respectively have a circular shape and the first and second means indicating at least one hour respectively have a circular shape concentric to the first and second display organs and bearing at least one index to indicate the hour on the associated display organ.

6. The display device according to claim 1, wherein the first and second hour display organs respectively assume the form of a cylinder and the first and second means for indicating at least one hour respectively assume the form of a cylinder concentric to the first and second display organs and bearing at least one index to indicate the hour on the associated display organ.

7. The display device according to claim 1, wherein the first and second means for indicating at least one hour can be arranged such that their respective indexes, with which a piece of information related to a location is associated, are aligned.

8. The display device according to claim 1, wherein the first and second means for indicating at least one hour can be arranged such that their respective indexes, with which a piece of information related to a location is associated, have a curved shape in the extension of each other.

9. The display device according to claim 1, wherein each of the first and second display organs have one color to display the hours corresponding to the daytime and another color to display the hours corresponding to the nighttime.

10. A timepiece comprising:

a device for displaying multiple hours comprising a first hour display organ and a second hour display organ, said first hour display organ and said second hour display organ together constituting first elements, wherein the first and second hour display organs have a shared axis;

first means indicating at least one hour on the first hour display organ and second means indicating at least one hour on the second hour display organ, said first means and said second means together constituting second elements, wherein at least one of the first and second means for indicating at least one hour is positioned between the first hour display organ and the second hour display organ, wherein all component parts constituting one group from among said first and second elements is mounted rotating around said axis with respect to all component parts constituting the other of said first and second elements, all component parts of said one group rotating with a same speed of rotation of one turn in twenty four hours, the hour that is displayed on the first hour display organ being different from the hour that is displayed on the second hour display organ, wherein the first and second means for indicating at least one hour respectively comprise at least one index with which a piece of information related to a location is associated, and wherein the first and second hour display organs and the first and second means indicating at least one hour also be arranged so as to be able to be positioned relative to one another such that the deviation between the hours displayed on the hour display organs by the indexes of the first and second indicator means for indicating at least one hour; and rotational driving means designed to rotate said component parts of said group from among the first and second movable elements at said speed of rotation.

* * * * *